US008398172B2

(12) United States Patent
Fontaine

(10) Patent No.: US 8,398,172 B2
(45) Date of Patent: Mar. 19, 2013

(54) SPIRAL JAW LOCKING MECHANISM FOR ADJUSTMENT SYSTEM IN CHAIRS

(75) Inventor: Éric Fontaine, St-Liboire (CA)

(73) Assignee: Groupe Dutailier Inc., Saint-Pie (Quebec) (CA)

( * ) Notice: Subject to any disclaimer, the term of this patent is extended or adjusted under 35 U.S.C. 154(b) by 357 days.

(21) Appl. No.: 12/813,718

(22) Filed: Jun. 11, 2010

(65) Prior Publication Data

US 2011/0304185 A1 Dec. 15, 2011

(51) Int. Cl.
*A47C 1/00* (2006.01)

(52) U.S. Cl. ..... 297/344.11; 297/337

(58) Field of Classification Search ..... 297/344.11, 297/337

See application file for complete search history.

(56) References Cited

U.S. PATENT DOCUMENTS

| | | | | |
|---|---|---|---|---|
| 3,936,091 | A | 2/1976 | Rabinowitz | |
| 4,540,148 | A | 9/1985 | Jann | |
| 4,728,072 | A | 3/1988 | Mitchell | |
| 5,029,940 | A | 7/1991 | Golynsky et al. | |
| 6,135,524 | A | 10/2000 | Faller et al. | |
| 6,634,711 | B2 * | 10/2003 | Phillips et al. | 297/344.11 X |
| 6,719,372 | B2 | 4/2004 | Glaspie et al. | |
| 7,611,201 | B2 | 11/2009 | Moriyama et al. | |
| 2005/0248194 | A1 * | 11/2005 | Hsien | 297/344.11 |
| 2007/0170767 | A1 | 7/2007 | Oberlaender et al. | |

* cited by examiner

*Primary Examiner* — Rodney B White
(74) *Attorney, Agent, or Firm* — McDermott Will & Emery LLP

(57) ABSTRACT

A locking chair adjustment mechanism for adjusting a position of a chair component. The mechanism comprises a central shaft, a spiral jaw clutch comprising two interconnecting spiral jaw interfaces and a slotted element wherein the slot is sized to slideably receive the central shaft for displacement of the slotted element when the mechanism is in an unlocked position. A locking pad locks the mechanism against the slotted element. A rotatable adjustment handle allows the mechanism to toggle from a locked position, to an unlocked position, by displacement of the spring mechanism caused by the rotation of the spiral jaw interface fixedly mounted on the adjustment handle, therefore releasing pressure on the locking pad. A spring mechanism is activated when the claimed mechanism goes from a locked position to an unlocked position, pulling the claimed mechanism back to a locked position. The claimed mechanism provides a low cost solution offering better locking capabilities than traditional braking mechanisms.

10 Claims, 5 Drawing Sheets

SPIRAL JAW LOCKING MECHANISM FOR ADJUSTMENT SYSTEM IN CHAIRS

FIELD OF THE INVENTION

The present invention generally relates to a locking adjustment system for chairs. More particularly, it relates to a spiral jaw locking mechanism for an adjustment system in chairs.

BACKGROUND OF THE INVENTION

Several types of chairs are provided with reclining mechanisms. Certain reclining mechanisms in chairs include a base structure that allows the seat to slide forwards and backwards and cause inclination of the back part of the seat. Current locking mechanisms that are used to stop movement of the base structure and keep the seat base from sliding typically include nut and bolt type interfaces. However, this type of interface does not provide adequate locking capability for positioning of the seat. Bolt systems are typically not very performant and sometimes are subjected to problems after long periods of use.

Several different prior art mechanisms using spiral jaws as part of an adjustment mechanism in chairs, or other apparatuses, are known to the Applicant.

U.S. Pat. No. 6,135,524 (Faller et al.) discloses a frame structure (unrelated to a chair mechanism) using a spiral jaw clutch type system for the translational movement of a rod against a spring in order to adjust the configuration of a mechanism inside a structure.

US 2007/0170767 (Oberlaender et al.) teaches an adjustment mechanism for a surgical armrest using a spiral jaw clutch type system for the adjustment of a mechanism of the armrest.

U.S. Pat. No. 5,029,940 (Golynsky et al.) teaches a chair tilt and chair height control apparatus where the tilt control mechanism uses a spiral jaw clutch type system to control the adjustment of the tilting of a section of the chair.

Other mechanisms known to the Applicant include U.S. Pat. No. 3,936,091 (Rabinowitz); U.S. Pat. No. 4,540,148 (Jann); U.S. Pat. No. 4,728,072 (Mitchell); U.S. Pat. No. 6,719,372 (Glaspie et al.); and U.S. Pat. No. 7,611,201 (Moriyama et al.).

However, none of the prior art documents cited above discloses a spiral jaw clutch mechanism for locking and unlocking an adjustment system sliding along a slotted element and associated with the positioning of a chair seat.

Consequently, there is presently a need for a chair adjustment mechanism that uses a spiral jaw clutch to offer improved locking performance and operate reliably over a longer period of time.

SUMMARY OF THE INVENTION

An object of the present invention is to provide a locking chair adjustment mechanism that addresses at least one of the above-mentioned needs.

According to the present invention, there is provided a locking chair adjustment mechanism for adjusting a position of a chair component, the mechanism comprising:

- a central shaft;
- a spiral jaw clutch comprising two interconnecting spiral jaw interfaces wherein one of the spiral jaw interface is fixedly mounted on a rotatable adjustment handle;
- a slotted element wherein the slot is sized to slideably receive the central shaft for displacement of the slotted element when the mechanism is in an unlocked position;

- a locking pad for locking the mechanism against the slotted element;
- a spring mechanism attached to the locking pad;
- a rotatable adjustment handle to toggle the adjustment mechanism from a locked position to an unlocked position by rotating the spiral jaw interface fixedly mounted on the adjustment handle in order to produce a displacement of the spring mechanism therefore releasing pressure on the locking pad, wherein the chair component is mounted on the slotted element and the position of the component is adjusted through corresponding movement along the longitudinal movement of the slot, and wherein the spring mechanism urges the adjustment mechanism towards the locked position when the adjustment mechanism is in the unlocked position.

The use of the spiral jaw clutch and spring mechanism provides a low cost solution offering improved locking capabilities than traditional braking mechanism for certain applications, while operating reliably over a period of time.

BRIEF DESCRIPTION OF THE DRAWINGS

These and other objects and advantages of the invention will become apparent upon reading the detailed description and upon referring to the drawings in which.

DETAILED DESCRIPTION OF PREFERRED EMBODIMENTS OF THE INVENTION

Figure 1:
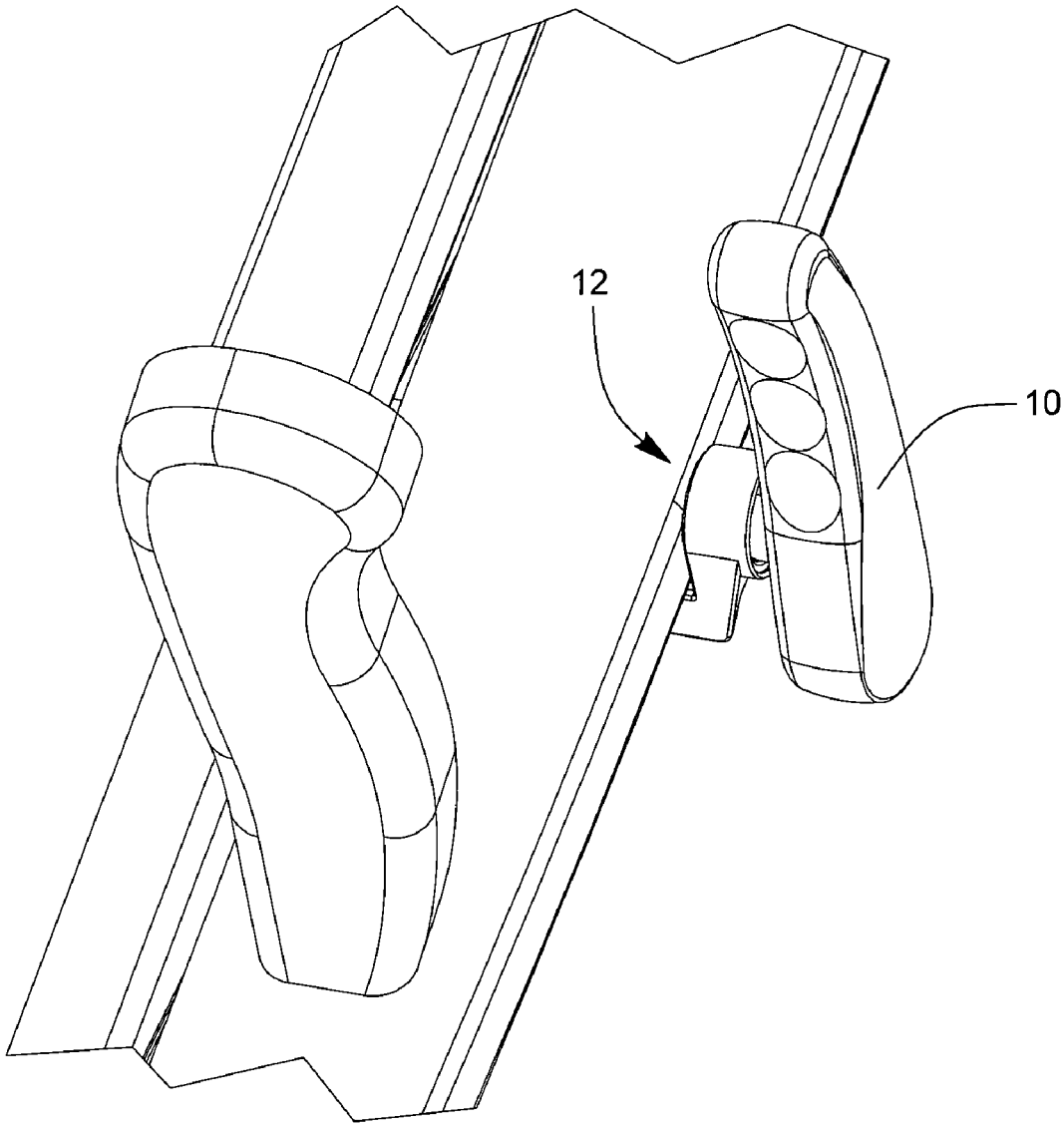
FIG. 1 is a perspective view of the claimed mechanism in accordance with a preferred embodiment of the present invention.

In the following description, the same numerical references refer to similar elements. The embodiments shown in the figures are preferred.

Moreover, although the present invention was primarily designed for use with adjustment of a seat bottom of a chair, it may be used with other types of chair components, as apparent to a person skilled in the art. For this reason, expressions such as "chair" or "seat" used herein should not be taken as to limit the scope of the present invention and include all other kinds of chair assemblies or items with which the present invention could be used and may be useful.

Moreover, in the context of the present invention, expressions such as "structure" and any other equivalent expressions and/or compound words thereof known in the art will be used interchangeably.

In addition, although the preferred embodiments of the present invention are illustrated in the accompanying drawings and although the preferred embodiments of the adjustment mechanism as shown consist of certain geometrical configurations as explained and illustrated herein, not all these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the adjustment mechanism and corresponding parts according to the present invention, as briefly explained and inferred herein, without departing from the scope of the invention.

Referring to any one of FIGS. 1 to 5C, a locking chair adjustment mechanism is shown, the mechanism comprises a central shaft 11 and a spiral jaw clutch 12 comprising two interconnecting spiral jaw interfaces 14 and 16. One of the spiral jaw interface 16 is fixedly mounted on a rotatable adjustment handle 10. A slotted element 19 is also provided wherein the slot is sized to slideably receive the central shaft 11 for displacement of the slotted element 19 when the mechanism is in an unlocked position shown in FIG. 5. A locking pad 18 for locking the mechanism against the slotted element 19 is also provided with a spring mechanism 22 attached to it. Finally, a rotatable adjustment handle 10 allows the mechanism to toggle from a locked position shown in FIG. 4, to an unlocked position shown in FIG. 5, by rotating the spiral jaw interface 16 fixedly mounted on the adjustment handle 10 in order to produce a displacement of the spring mechanism 22 therefore releasing pressure on the locking pad 18. The chair component 23 is mounted on the slotted element 19 and the position of the component 23 is controlled through corresponding movement along the longitudinal movement of the slot 20. The spring mechanism 22 is activated when the claimed mechanism goes from a locked position shown in FIG. 4, to an unlocked position shown in FIG. 5, pulling the claimed mechanism back to a locked position.

Figure 2:
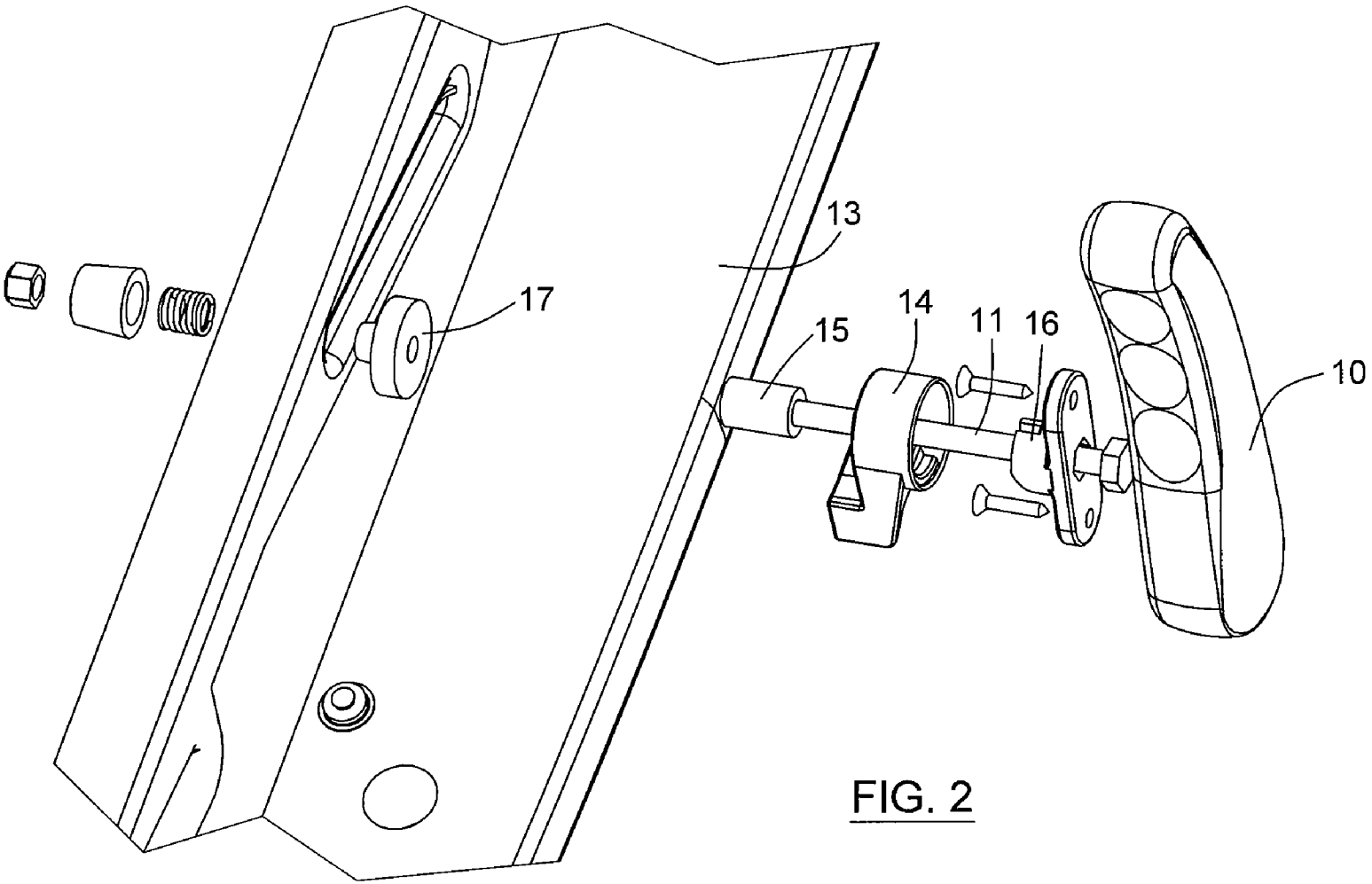
FIG. 2 is an exploded view of the locking adjustment mechanism shown in FIG. 1.
Figure 3B:
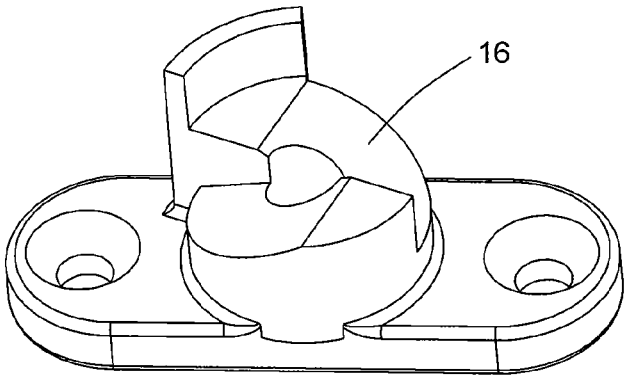
FIG. 3A is another exploded view of the locking adjustment mechanism shown in FIG. 1, with FIGS. 3B and 3C highlighting the spiral jaw interface components of the mechanism.
Figure 3A:
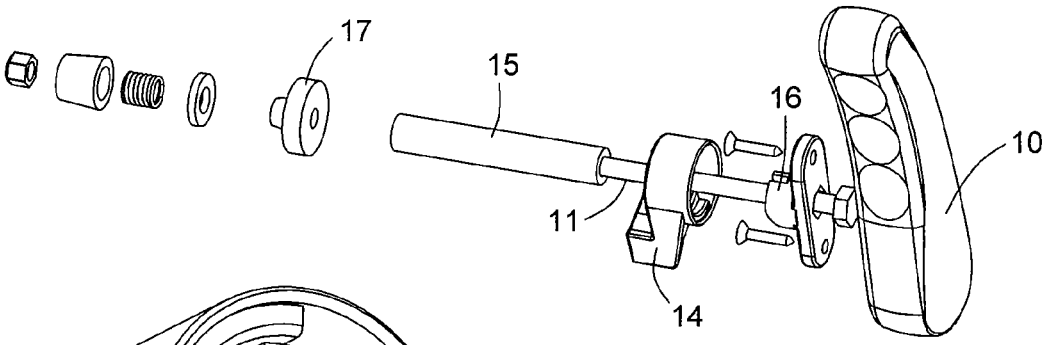
Figure 3C:
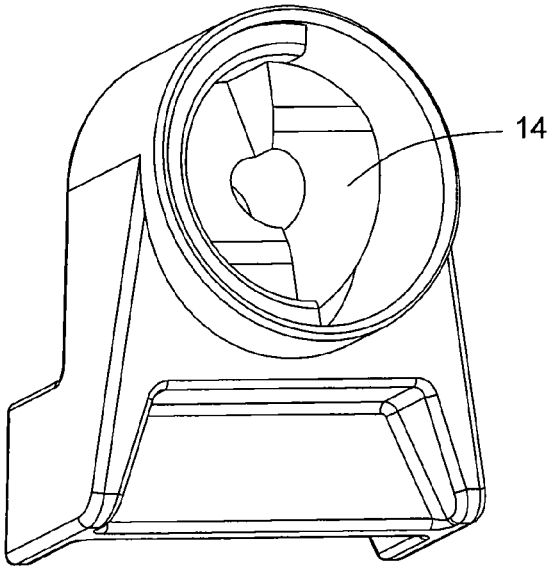
Figure 4C:
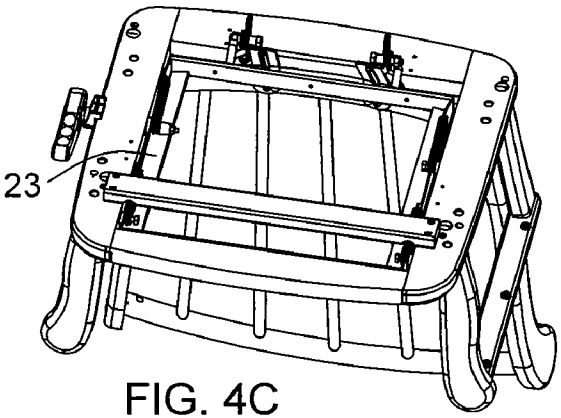
FIG. 4A is a bottom perspective view of the locking adjustment mechanism shown in FIG. 1, in a locked position, with FIGS. 4B and 4C showing top and bottom perspective views of the mechanism positioned on a chair.
Figure 4A:
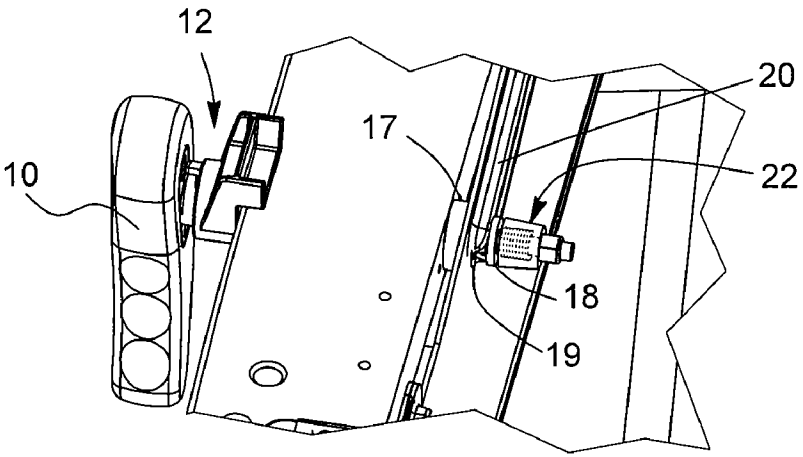
Figure 4B:
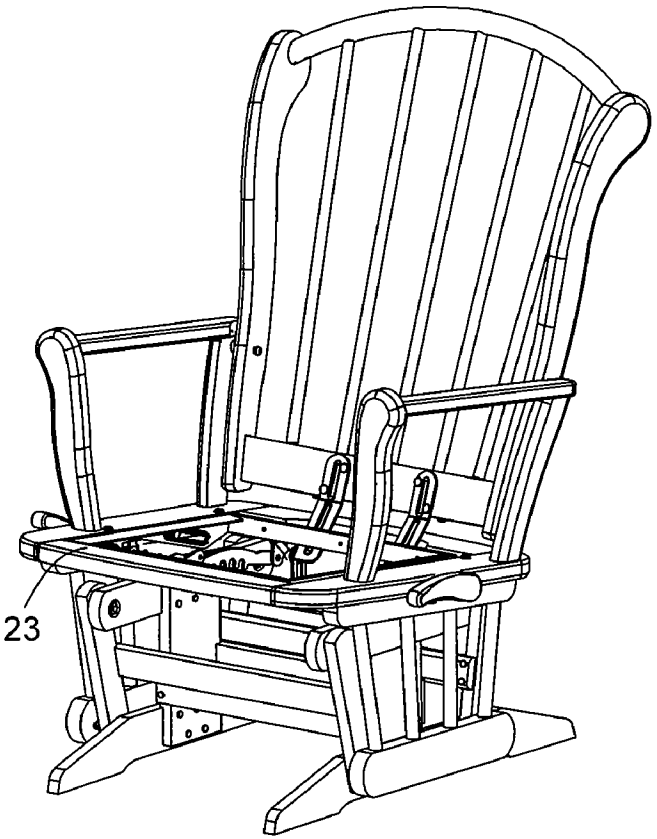
Figure 5C:
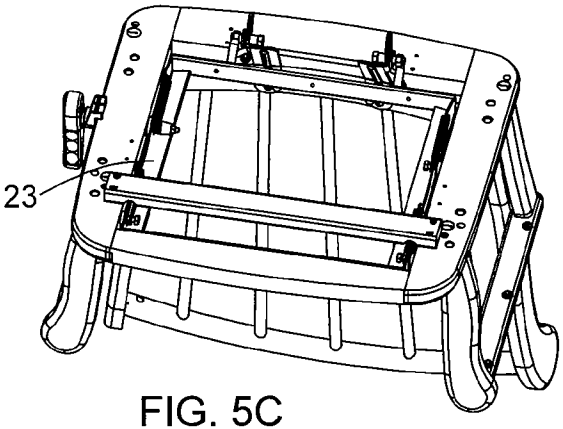
FIG. 5A is a bottom perspective view of the locking adjustment mechanism shown in FIG. 1, in an unlocked position, with FIGS. 5B and 5C showing top and bottom perspective views of the mechanism positioned on a chair.
Figure 5A:
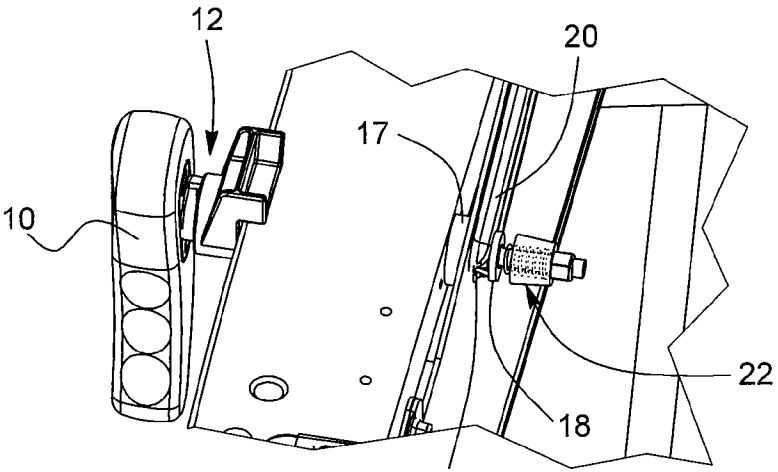
Figure 5B:
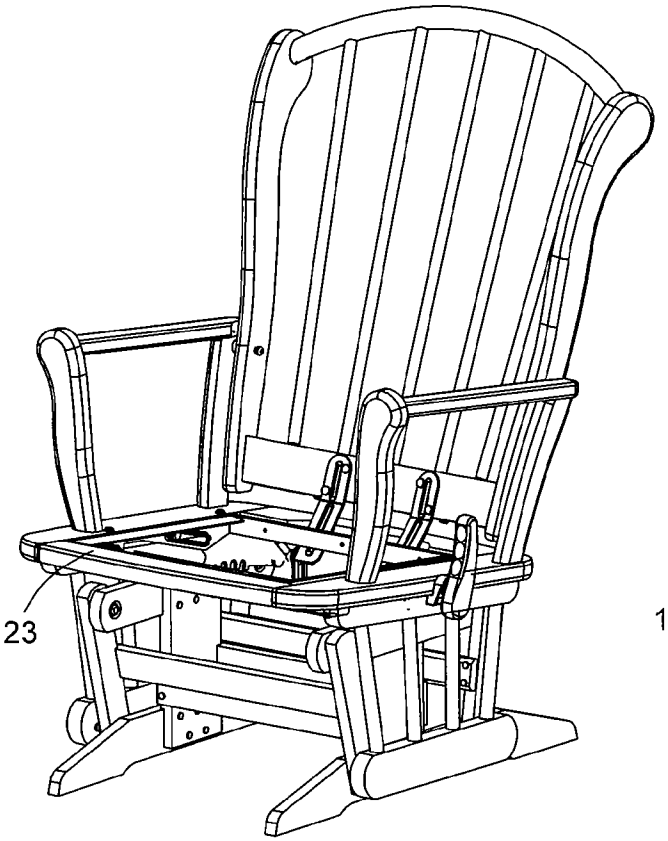

Preferably, as better shown in FIG. 2, a position of the central shaft 11 is maintained by a fixed structure 13 of the chair, the structure 13 being traversed by the central shaft 11.

Preferably, as better shown in FIG. 2 as well, a portion of the central shaft 11 is covered with a sheath 15 traversing the fixed structure 13.

Preferably, as better shown in FIGS. 2, 4A to 4C and 5A to 5C, a washer 17 is positioned between the fixed structure 13 of the chair and the slotted element 19, the washer 17 being coaxially mounted onto the central shaft 11.

Preferably, the chair component is a chair seat bottom whose displacement is reflected in the inclination of the back part of the seat. However, the adjustment mechanism according to the present invention may be used for adjustment of other chair components.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

The invention claimed is:

1. A locking chair adjustment mechanism for adjusting a position of a chair component, said mechanism comprising:

a central shaft;

a spiral jaw clutch comprising two interconnecting spiral jaw interfaces wherein a first one of said spiral jaw interfaces is fixedly mounted on a rotatable adjustment handle;

a slotted element wherein a slot is formed in the slotted element, the slot being sized to slideably receive said central shaft therein for displacement of said slotted element when the mechanism is in an unlocked position;

a locking pad for locking the mechanism against said slotted element;

a spring mechanism attached to said locking pad;

a rotatable adjustment handle to toggle the adjustment mechanism from a locked position to an unlocked position by rotating said first one of said spiral jaw interfaces in order to produce a displacement of said spring mechanism to release pressure on said locking pad, wherein the chair component is mounted on said slotted element and the position of the component is adjusted through displacement of the central shaft within the slot formed in the slotted element, and wherein said spring mechanism urges said adjustment mechanism towards the locked position when said adjustment mechanism is in the unlocked position.

2. The chair adjustment mechanism according to claim 1, wherein a position of said central shaft is maintained by a fixed structure of the chair, said structure being traversed by said central shaft.

3. The chair adjustment mechanism according to claim 2, wherein said chair component is a chair seat bottom.

4. The chair adjustment mechanism according to claim 2, wherein a portion of said central shaft is covered with a sheath traversing said fixed structure.

5. The chair adjustment mechanism according to claim 3, further comprising a washer positioned between said fixed structure of the chair and said slotted element, said washer being coaxially mounted onto said central shaft.

6. The chair adjustment mechanism according to claim 5, wherein said chair component is a chair seat bottom.

7. The chair adjustment mechanism according to claim 4, wherein said chair component is a chair seat bottom.

8. The chair adjustment mechanism according to claim 2, further comprising a washer positioned between said fixed structure of the chair and said slotted element, said washer being coaxially mounted onto said central shaft.

9. The chair adjustment mechanism according to claim 8, wherein said chair component is a chair seat bottom.

10. The chair adjustment mechanism according to claim 1, wherein said chair component is a chair seat bottom.

* * * * *